US009657591B2

(12) United States Patent
Schleif et al.

(10) Patent No.: US 9,657,591 B2
(45) Date of Patent: May 23, 2017

(54) DAMPING SYSTEM FOR A TURBOMACHINE SLIP RING

(71) Applicant: General Electric Company, Schenectady, NY (US)

(72) Inventors: Kurt Kramer Schleif, Greenville, SC (US); Donald W. Shaw, Simpsonville, SC (US); Zachary John Snider, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 493 days.

(21) Appl. No.: 14/501,263

(22) Filed: Sep. 30, 2014

(65) Prior Publication Data

US 2016/0090860 A1 Mar. 31, 2016

(51) Int. Cl.
*F01D 25/04* (2006.01)
*F01D 21/00* (2006.01)

(52) U.S. Cl.
CPC ..... *F01D 25/04* (2013.01); *F01D 21/003* (2013.01); *F05D 2270/80* (2013.01)

(58) Field of Classification Search
CPC ..... F01D 25/04; F01D 5/10; F01D 21/003; F05D 2260/96; F05D 2260/40
USPC ..... 415/119
See application file for complete search history.

(56) References Cited

U.S. PATENT DOCUMENTS 3,984,716 A * 10/1976 Stark ..... H02K 13/003 310/227

* cited by examiner

*Primary Examiner* — Gregory Anderson
*Assistant Examiner* — Michael Sehn
(74) *Attorney, Agent, or Firm* — Dority & Manning, PA

(57) ABSTRACT

A damping system for a turbomachine slip ring includes a slip ring assembly. The slip ring assembly includes a rotating component which is coupled at one end to a rotor shaft of the turbomachine and a stator component which circumferentially surrounds a rotatable center core portion of the rotating component. The system further includes a static structure which defines a carrier sleeve where the carrier sleeve circumferentially surrounds a portion of the stator component. The system also includes a damping material which extends radially between an inner surface of the carrier sleeve and an outer surface of the stator component so as to dissipate vibrational energy of the slip ring assembly during rotation of the rotor shaft.

20 Claims, 5 Drawing Sheets

DAMPING SYSTEM FOR A TURBOMACHINE SLIP RING

FIELD OF THE INVENTION

The present invention generally involves a slip ring which is coupled to a rotor shaft of a turbomachine. More specifically, the present invention involves a damping system for dissipating vibrational energy at the slip ring during rotation of the rotor shaft.

BACKGROUND OF THE INVENTION

Numerous machines include rotating components. For example, turbomachines such as wind turbines, gas turbines, steam turbines, pumps, fans, generators, motors, and other forms of commercial equipment frequently include shafts, blades, and other rotating components. It is known in the art to install one or more sensors on the rotating components to measure various characteristics of the rotating components in order to control, monitor, and/or enhance the operation of the rotating components. For example, sensors that measure the temperature, velocity, stress, strain, vibrations, and/or other characteristics of the rotating components may allow for early detection of abnormalities, adjustments to repair or maintenance schedules, and/or other actions to enhance operations.

Various slip ring and telemetry systems are known in the art for transmitting the sensor data from the rotating components to stator components for further analysis. A slip ring assembly generally includes a rotating component which is fixedly coupled to a rotor shaft of the turbomachine and which includes a rotating center core or shaft. The center core is electronically coupled to the sensors within the turbomachine. Multiple contact surfaces are defined along the center core and each contact surface is electronically coupled to one or more of the sensors. The slip ring assembly also includes a stator or stator component which at least partially surrounds the center core. The stator includes multiple brushes mounted within an outer body and which make electrical contact with one or more of the contact surfaces of the center core. An electrical signal or current from the sensors is transferred via the brushes from the rotating center core to a signal processor such as a computing device and/or controller.

In particular configurations, the stator of the slip ring assembly may be supported by multiple bearings which are mounted on the center core. As a result, the cantilevered stator is susceptible to vibration due to various factors which may include rotor shaft imbalance, slip ring imbalance and/or slip ring run out. A free end of the slip ring, the furthest point from the rotor connection, is the point at which vibration amplitude may be the highest. As a result, it is plausible for the slip ring to experience excessive vibrations which may impact overall performance of the slip ring. Therefore, a damping system for a turbomachine slip ring which is coupled at one end to the rotor shaft would be useful.

BRIEF DESCRIPTION OF THE INVENTION

Aspects and advantages of the invention are set forth below in the following description, or may be obvious from the description, or may be learned through practice of the invention.

One embodiment of the present invention is a damping system for a turbomachine slip ring. The damping system includes a slip ring assembly which includes a rotating component that is coupled at one end to a rotor shaft of the turbomachine and a stator component which circumferentially surrounds at least a portion of a rotatable center core portion of the rotating component. The stator component is axially spaced from the coupled end of the rotating component. The system further includes a static structure which defines a carrier sleeve where the carrier sleeve circumferentially surrounds at least a portion of the stator component. The system further includes a damping material that extends radially between an inner surface of the carrier sleeve and an outer surface of the stator component so as to dissipate vibrational energy of the slip ring assembly during rotation of the rotor shaft.

Another embodiment of the present invention is a turbomachine. The turbomachine includes a rotor shaft which extends along an axial centerline of the turbomachine and a slip ring assembly which includes a rotating component that is coupled at one end to a corresponding end of the rotor shaft. The slip ring assembly further includes a stator component that circumferentially surrounds a rotatable center core portion of the rotating component. The stator component is axially spaced from the coupled end of the rotating component. The turbomachine further includes a static structure which includes a carrier sleeve. The carrier sleeve circumferentially surrounds a portion of the stator component. The static structure is vibrationally isolated from the turbomachine rotor shaft. The turbomachine further includes a damping material which extends radially between an inner surface of the carrier sleeve and an outer surface of the stator component and is positioned so as to dissipate vibrational energy of the slip ring assembly during rotation of the rotor shaft.

The present invention also includes a gas turbine. The gas turbine includes a compressor, a combustion section disposed downstream from the compressor, a turbine disposed downstream from the combustion section and a rotor shaft which extends through the compressor, combustion section and the turbine along an axial centerline of the gas turbine. The gas turbine further includes a slip ring assembly. The slip ring assembly includes a rotating component coupled at one end to a corresponding end of the rotor shaft and a stator component circumferentially surrounding a rotatable center core portion of the rotating component. The center core portion is electronically coupled to one or more sensors disposed within the gas turbine and the stator component is electronically connected to a data acquisition unit. The stator component is axially spaced from the coupled end of the rotating component. The gas turbine further includes a static structure which includes a carrier sleeve. The carrier sleeve circumferentially surrounds at least a portion of the stator component and is vibrationally isolated from the gas turbine rotor shaft. The gas turbine further includes a damping material which extends radially between an inner surface of the carrier sleeve and an outer surface of the stator component. The damping material dissipates vibrational energy of the slip ring assembly during rotation of the rotor shaft.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a gas turbine for purposes of illustration, one of ordinary skill in the art will readily appreciate that embodiments of the present invention may be applied to any turbomachine having a slip ring assembly coupled to a rotor shaft such as a steam turbine, a wind turbine, a fan or the like and the specification is not intended to be limited to a gas turbine turbomachine unless otherwise specified in the claims.

The invention as disclosed in various embodiments herein provides a damping system for a slip ring assembly coupled to one end of a rotor shaft of a turbomachine such as a gas, steam or wind turbine. A slip ring assembly is an instrumentation device used to communicate electrical signals from a rotating sensor, such as a thermocouple or strain gage, to a stationary, remotely located data acquisition system. The slip ring assembly is traditionally mounted on the forward or aft end of a rotor shaft of the turbo machine. The stator component of the slip ring assembly may be at least partially supported by multiple bearings mounted on the slip ring center bore. The cantilevered stator component may be susceptible to vibration due to various conditions such as but not limited to rotor imbalance, slip ring imbalance and/or slip ring run-out. The free end of the slip ring assembly, the furthest point from the rotor shaft connection, is the point at which vibration amplitude may be the highest. Depending on the design of the slip ring assembly, it is plausible for the slip ring assembly to experience mechanical failure and/or signal loss if vibrations are excessive.

The system described and claimed herein reduces free-end vibration of the slip ring stator component by utilizing a damping material disposed within a carrier slot of a static structure which may be vibrationally isolated from the rotor shaft of the turbomachine. The damper material may be a compliant knitted mesh that dampens high-frequency vibration while permitting slow global motion and axial movement such as thermal growth of the rotor. Use of the damping system extends the life of the slip ring assembly, and may reduce the probability of mechanical failure due excessive vibration (displacement).

Figure 1:
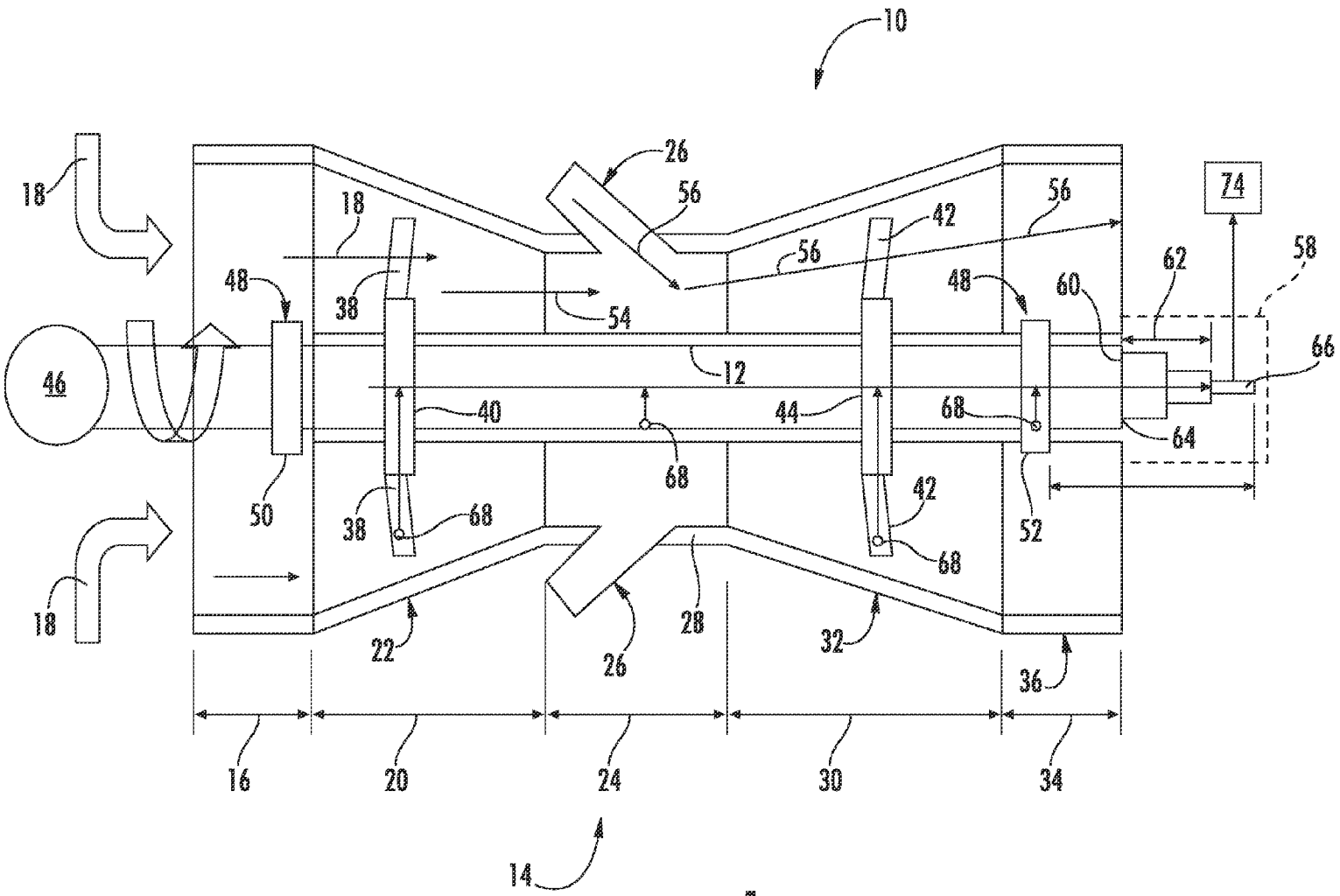
FIG. 1 provides a functional block diagram of an exemplary turbomachine having a rotor shaft which extends along an axial centerline of the turbomachine as may incorporate various embodiments of the present invention.

Referring now to the drawings, wherein identical numerals indicate the same elements throughout the figures, FIG. 1 provides a functional block diagram of an exemplary turbomachine 10 having a rotor shaft 12 which extends along an axial centerline of the turbomachine 10. In particular embodiments, as shown in FIG. 1 the turbomachine 10 is a gas turbine 14. As shown in FIG. 1, the gas turbine 14 generally includes an inlet section 16 that may include a series of filters, cooling coils, moisture separators, and/or other devices (not shown) to purify and otherwise condition air 18 entering the gas turbine 14. A compressor section 20 including a compressor 22 is disposed downstream from the inlet section 16. A combustion section 24 is disposed downstream from the compressor section 20 and may include a plurality of combustors 26 annularly arranged around an outer casing 28 such as a compressor discharge casing.

A turbine section 30 including a high and/or low pressure turbine 32 is disposed downstream from the combustion section 24. In one embodiment, the gas turbine 14 includes an exhaust section 34 which includes an exhaust duct or diffuser 36 which is disposed downstream from an outlet of the turbine 34. In particular embodiments, the inlet section 16, compressor 22, the combustion section 24, turbine 32 and the exhaust duct 36 define a primary flow passage through the gas turbine 12.

The compressor 20 generally includes multiple rows or stages of compressor blades 38 (only one stage shown) where each row of compressor blades 38 is coupled to the rotor shaft 12 via a compressor rotor disk 40. In addition, the turbine 32 generally includes multiple rows or stages of turbine blades 42 where each row of turbine blades is coupled to the rotor shaft 12 via a turbine rotor disk 44. The compressor and turbine blades 38, 42 are generally mounted, angled and/or formed such that rotation of the rotor shaft 12 causes the air 18 to be drawn through the inlet section 16 and into the compressor 22. Although illustrated as counter-clockwise, the rotational direction may be either clockwise or counter-clockwise depending on the configuration of the compressor and turbine blades 38, 42. In particular embodiments, the rotor shaft 12 may be connected to a motor and/or a generator 46 in order to turn the rotor shaft 12 and/or to generate electrical power and/or mechanical work.

The rotor shaft 12 may be a single shaft or may include multiple shafts coupled together to form a singular shaft through the turbomachine 10 or gas turbine 14. In particular configurations, the rotor shaft 12 is at least partially supported by multiple bearing assemblies 48 including but not limited to thrust and/or journal bearing assemblies. In particular configurations, the turbomachine 10 or gas turbine 14 includes a forward bearing assembly 50 disposed near or adjacent to the inlet section 16 and an aft bearing assembly 52 disposed near or adjacent to the turbine and/or exhaust sections 30, 34.

In operation, the air 18 is drawn through the inlet section 16 and into the compressor 22 where it is progressively compressed so as to provide compressed air 54 to the combustion section 24. The compressed air 54 is routed to the combustors 26 where it is mixed with a fuel. The fuel-air mixture in each combustor 26 is burned, thus generating high temperature combustion gases 56 at a high velocity. The combustion gases 56 are routed through the turbine 32 where thermal and kinetic energy are transferred from the combustion gases 56 to the turbine blades 42, thus causing the rotor shaft 12 to rotate. The combustion gases 56 are exhausted through the exhaust duct 36

In various embodiments of the present invention, a slip ring assembly 58 is coupled to one end 60 of the rotor shaft 12. The slip ring assembly 58 is coaxially aligned with the rotor shaft 12. Although the slip ring assembly 58 is shown coupled to the rotor shaft 12 proximate to the aft bearing assembly 52, it should be appreciated by one of ordinary skill in the art that in other embodiments the slip ring assembly 58 may be coupled to an end of the rotor shaft 12 which is proximate to the forward bearing assembly 50. In some instances, rotating instrumentation wires may be routed through another piece of equipment which is mounted or coupled to the gas turbine 10 rotor shaft 12 such as a generator, gearbox or accessory skid. In any of these instances, the slip ring assembly 58 may be attached to the rotor shaft 12 via one or more of these components.

As shown in FIG. 1, the slip ring assembly 58 includes a rotating component or portion 62. A first end 64 of the rotating component 62 is coupled to the end 60 of the rotor shaft 12. The slip ring assembly 58 further includes a stationary or stator component 66 which extends axially outwardly from the rotating component 62 with respect to the axial centerline of the rotor shaft 12. In various embodiments, one or more sensors 68 are electronically coupled or connected to the rotating component 62.

The sensors 68 may be located on various rotatable components connected to the rotor shaft 12. The sensors 68 may comprise pressure detectors, strain gauges, or accelerometers that generate one or more signals reflective of vibrations or movement by the compressor blades 38, turbine blades 42, or other rotating components. In this manner, the characteristics detected by the sensors 68 may be used to determine the optimum or sub optimum flows that minimize or increase vibrations in the blades or rotating components, as desired. In other embodiments, the sensors 68 may comprise thermocouples or resistance temperature detectors that generate one or more signals reflective of the temperature of the various rotating components. One of ordinary skill in the art will readily appreciate that embodiments of the present invention are not limited to any particular sensor unless specifically recited in the claims.

Figure 2:
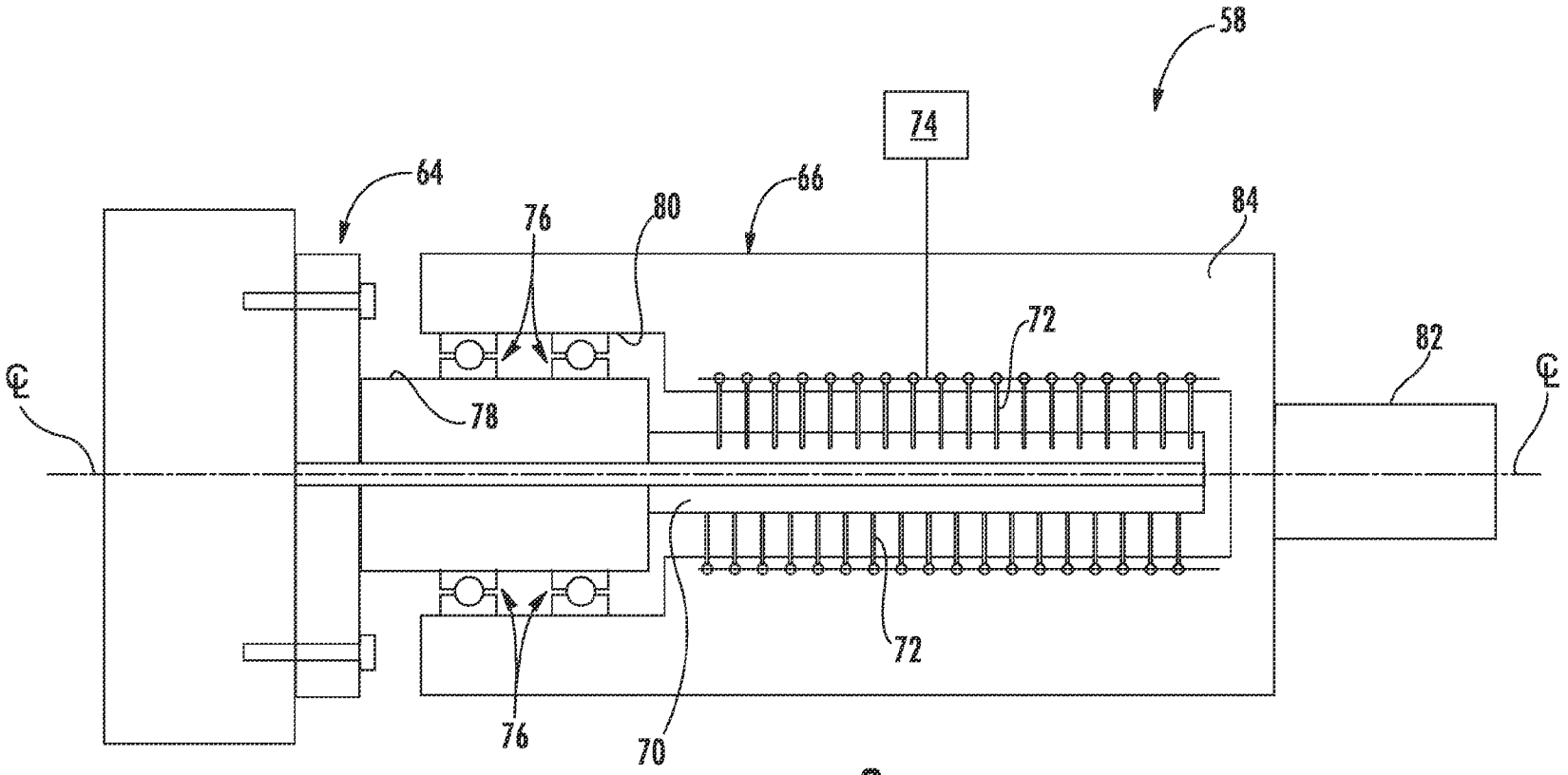
FIG. 2 is a cross sectional side view of a portion of an exemplary slip ring assembly as may be incorporated in various embodiment of the present invention.

FIG. 2 provides a cross sectional side view of a portion of an exemplary slip ring assembly 58 according to various embodiments. As shown in FIG. 2, the rotating component 62 includes a rotatable center core or shaft 70. The center core 70 is electronically coupled to the sensors 68 (FIG. 1) within the turbomachine 10. Multiple contact surfaces (not shown) are defined along the center core 70 and each contact surface is electronically coupled to one of the sensors 68. As shown in FIG. 2, the stator component 66 at least partially surrounds the center core 70. It should be appreciated by one of ordinary skill that although the slip ring assembly 58 shown and described herein is related to a tethered slip ring assembly, the invention as described may be applicable to a non-tethered slip ring assembly. A non-tethered slip ring assembly generally includes a center core which spins within the slip ring stator via multiple bearing assemblies. However, the slip ring stator of the non-tethered slip ring is also supported by a stationary structure.

The stator component 66 includes multiple brushes or contact arms 72 which make electrical contact with one or more of the contact surfaces of the center core 70. An electrical signal or current from the sensors 68 may be transferred via the brushes 72 from the rotating center core 70 to a signal processor 74 such as a computing device and/or a turbomachine controller.

In particular embodiments, the stator component 66 may be supported by multiple bearings assemblies 76 which extend radially between an outer surface 78 of the center core 70 and an inner surface 80 of the stator component 66. The bearing assemblies 76 allow the center core 70 to rotate freely within and/or with respect to the stator component 66. In particular embodiments, the stator component 66 includes a shaft or protrusion 82 which extends axially outwardly from a main or outer body 84 of the stator component 66. The shaft 82 may have any shape such as cylindrical, triangular, square, rectangular, and oval or the like. For example, in one embodiment the shaft 82 is cylindrical.

As previously presented, the slip ring assembly 58, particularly the cantilevered stator component 66 is susceptible to vibration due to various factors which may include rotor shaft imbalance, slip ring imbalance and/or slip ring run-out. As a result, it is plausible for the slip ring assembly 58 to experience excessive vibrations which may impact overall performance of the slip ring.

Figure 3:
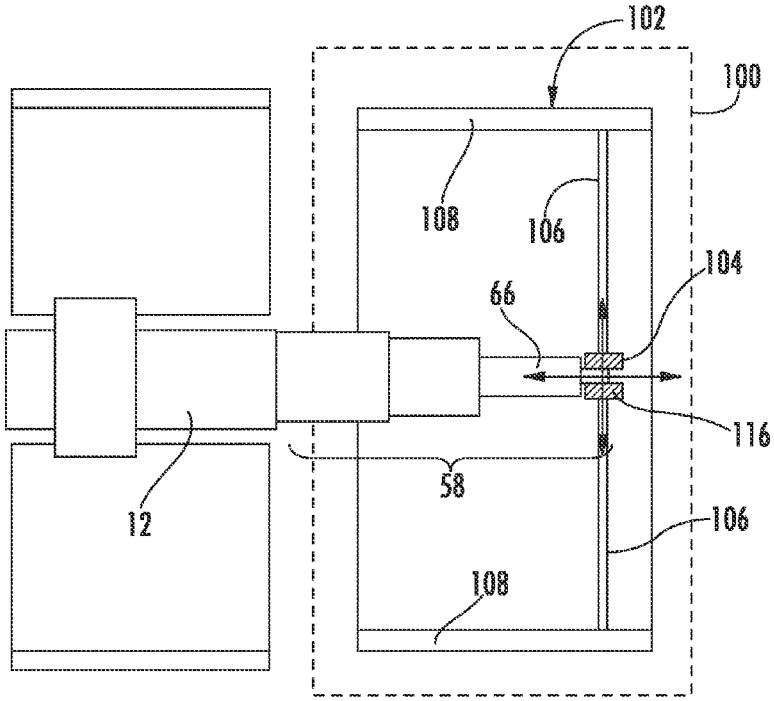
FIG. 3 is a cross sectional side view of a portion of the turbomachine as shown in FIG. 1 including a damping system for dissipating vibrational energy from the turbomachine slip ring assembly according to one embodiment of the present invention.
Figure 4:
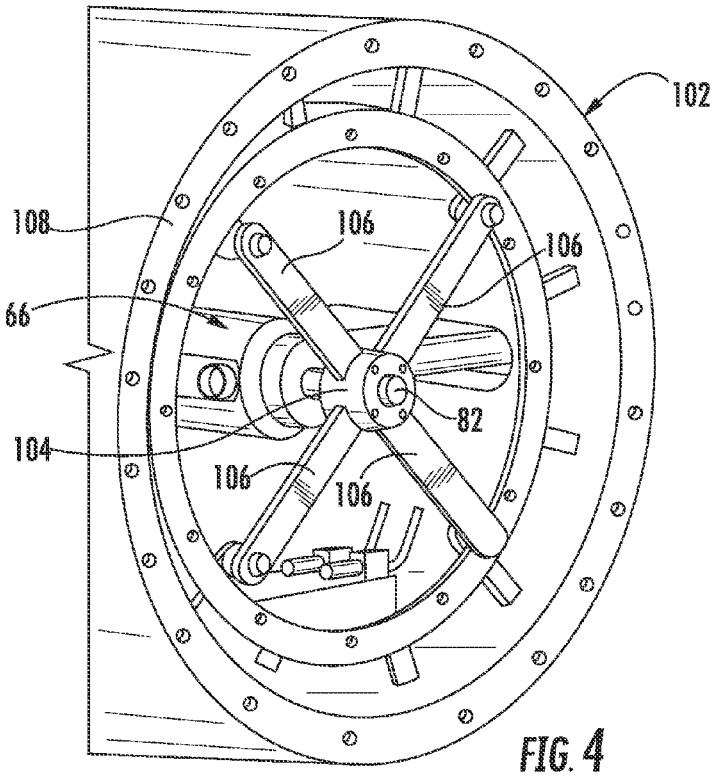
FIG. 4 is a perspective view of the damping system as shown in FIG. 2, according to one embodiment of the present disclosure.
Figure 5:
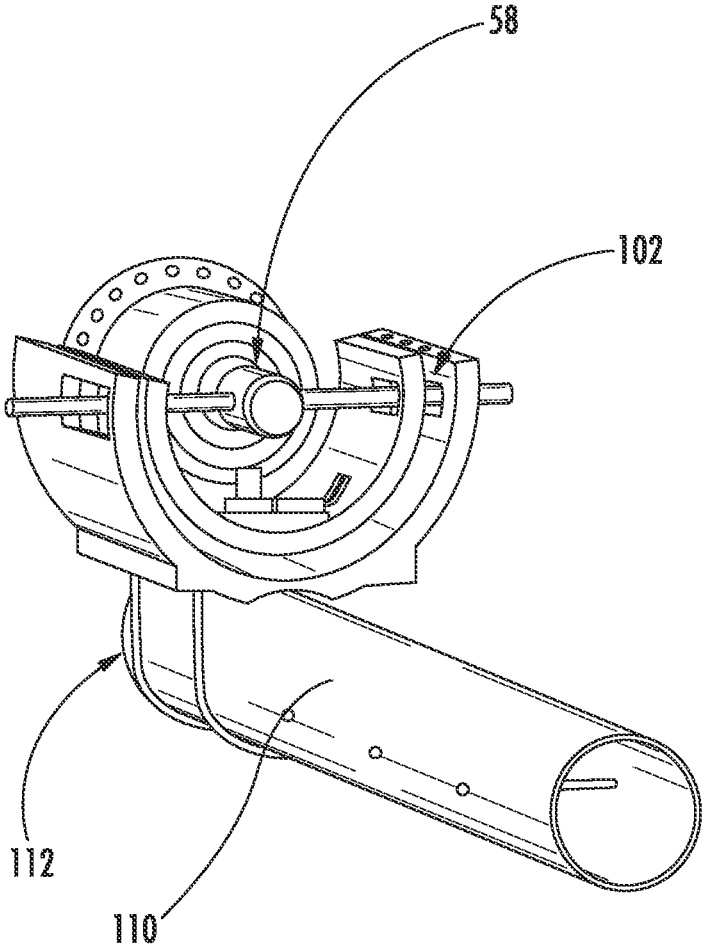
FIG. 5 is a perspective view of a portion of the damping system and a portion of the slip ring assembly as shown in FIG. 2, according to one embodiment of the present disclosure.
Figure 6:
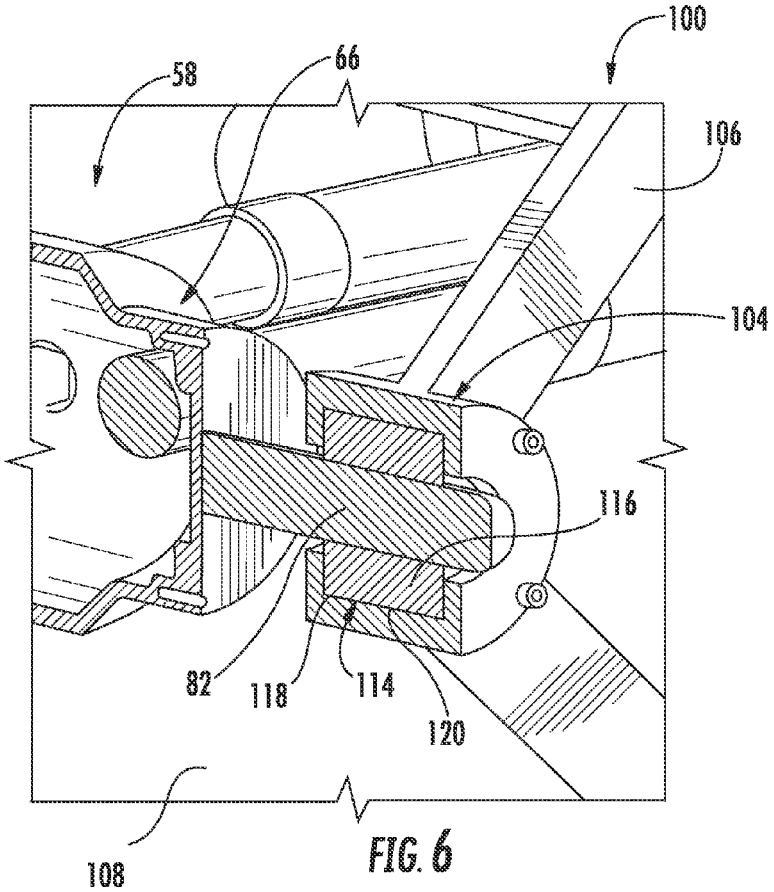
FIG. 6 is an enlarged cross sectional view of the damping system as shown in FIG. 4, according to one or more embodiments of the present invention.

FIG. 3 provides a cross sectional side view of a portion of the turbomachine 10 or gas turbine 14 including a portion of the rotor shaft 12, one of the rotor shaft bearing assemblies 48, the slip ring assembly 58 and a damping system 100 for dissipating vibrational energy from the turbomachine slip ring assembly 58. FIG. 4 provides a perspective view of the system 100 including a portion of the stator component 66 according to one embodiment of the present disclosure. FIG. 5 provides a perspective view of a portion of the system 100 and a portion of the slip ring assembly 58 according to one embodiment of the present disclosure. FIG. 6 provides an enlarged cross sectional view of the system 100 as shown in FIG. 4 according to one or more embodiments of the present invention.

In various embodiment's, as shown in FIG. 3, the system 100 includes a static structure 102 which circumferentially surrounds at least a portion of the slip ring assembly 58. The static structure 102 includes a carrier sleeve 104 which circumferentially surrounds at least a portion of the stator component 66. The carrier sleeve 104 is configured or formed to restrict movement of the stator component 66, particularly in the radial direction, while allowing for movement in other directions such as an axial direction during operation of the turbomachine 10. For example, as shown in FIGS. 3, 4 and 6, the carrier sleeve 104 may form a hub around a portion of the stator component 66 such as the shaft 82, thus allowing the stator component 66 to move axially therein.

In one embodiment, as shown in FIGS. 3 and 4, the static structure 102 includes multiple struts 106 which extend radially outwardly from the carrier sleeve 104 with respect to the axial centerline of the rotor shaft 12 and connect to an outer shroud 108 of the static structure 102, thus forming a hub and spoke configuration. In particular embodiments, the static structure 102 is vibrationally isolated from the rotor shaft 12 of the turbomachine 10. For example, in one embodiment, as shown in FIG. 5, the static structure 102 may be connected to a bearing oil supply conduit 110 or other structure which is vibrationally or otherwise independent of the turbomachine 10. The static structure 102 may be connected to the conduit 110 via any connection means 112 suitable to support the static structure 102 such as U-bolts, welding or the like.

In particular embodiments, as shown in FIGS. 3 and 6 the carrier sleeve 104 defines an annular slot 114. The slot 114 is formed to receive a damping material 116 therein. The damping material 116 extends radially between an inner surface 118 of the carrier sleeve 104 and an outer surface 120 of the stator component 66. The damping material 116 extends at least partially around the stator component 66. During rotation of the rotor shaft 12, the damping material 116 dissipates vibrational energy of the slip ring assembly 58 by restricting radial movement of the stator component 66 which may result from rotor shaft imbalance, slip ring imbalance and/or slip ring run-out.

Figure 7:
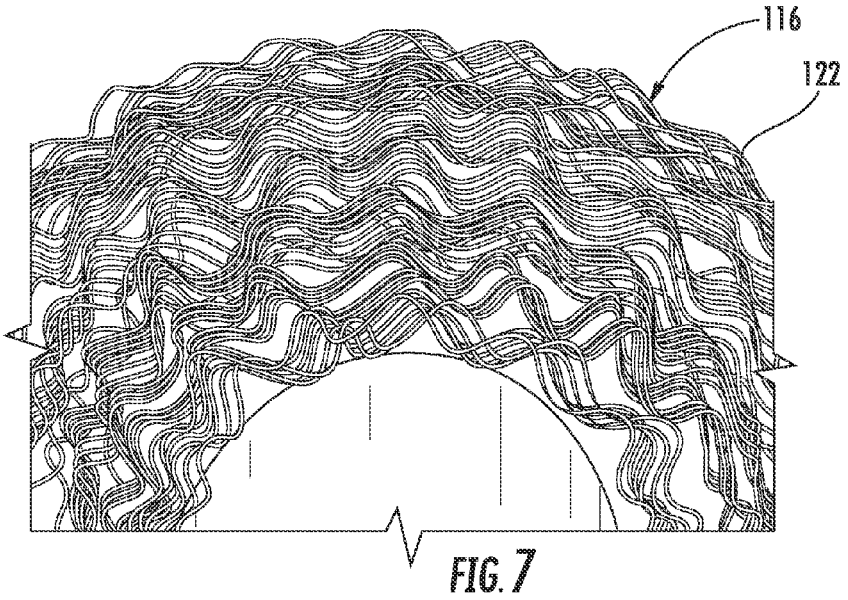
FIG. 7 is a perspective view of an exemplary damping material according to one embodiment of the present invention.

The damping material 116 may comprise any suitable damping material suitable for restricting radial movement of the slip ring assembly 58, particularly the stator component 66. For example, in one embodiment, as shown in FIG. 7, the damping material 116 may comprise of a wire-mesh material 122. More specifically, the damping material 116 may comprise of a knitted wire-mesh material 122.

The damping material 116 fits snuggly around the stator component 66, but is capable of allowing axial movement of the stator component 66. The damping material 116 may be stiff, but still compliant in the radial direction. The static structure 102 may be considered infinitely rigid with little or no vibration. As the stator component 66 begins to vibrate when the rotor shaft 12 spins, the stator component 66 moves radially, thus loading into the damping material 116. The knitted nature of the wire mesh damping material may create friction, thus dissipating the input energy from the stator component 66. The frictional forces restrict motion of the stator component 66, thus reducing displacement. The reduction in displacement prevents damage to the slip ring assembly 58.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A damping system for a turbomachine slip ring, comprising:

a slip ring assembly including a rotating component coupled at one end to a rotor shaft of the turbomachine and a stator component circumferentially surrounding a rotatable center core portion of the rotating component, wherein the stator component is axially spaced from the coupled end of the rotating component;

a static structure including a carrier sleeve, the carrier sleeve circumferentially surrounding a portion of the stator component; and a damping material, the damping material extending radially between an inner surface of the carrier sleeve and an outer surface of the stator component, wherein the damping material dissipates vibrational energy of the slip ring assembly during rotation of the rotor shaft.

2. The system as in claim 1, wherein the damping material comprises a wire-mesh material.

3. The system as in claim 2, wherein the wire-mesh material is a knitted wire mesh material.

4. The system as in claim 1, wherein the carrier sleeve is configured to allow axial movement of the stator component during operation of the turbomachine.

5. The system as in claim 1, wherein the portion of the stator component surrounded by the carrier sleeve includes an axially extending shaft fixed to an outer body of the stator component.

6. The system as in claim 1, wherein the shaft is cylindrical.

7. The system as in claim 1, wherein the static structure includes multiple struts which extend radially outwardly from the carrier sleeve and connect to an outer shroud.

8. The system as in claim 1, wherein the static structure is vibrationally isolated from the turbomachine rotor shaft.

9. The system as in claim 7, wherein the static structure is coupled to a bearing oil supply conduit.

10. A turbomachine, comprising:

a rotor shaft which extends along an axial centerline of the turbomachine;

a slip ring assembly including a rotating component coupled at one end to a corresponding end of the rotor shaft and a stator component circumferentially surrounding a rotatable center core portion of the rotating component, wherein the stator component is axially spaced from the coupled end of the rotating component;

a static structure including a carrier sleeve, the carrier sleeve circumferentially surrounding a portion of the stator component, wherein the static structure is vibrationally isolated from the turbomachine rotor shaft; and a damping material, the damping material extending radially between an inner surface of the carrier sleeve and an outer surface of the stator component, wherein the damping material dissipates vibrational energy of the slip ring assembly during rotation of the rotor shaft.

11. The turbomachine as in claim 10, wherein the damping material comprises a wire-mesh material.

12. The turbomachine as in claim 11, wherein the wire-mesh material is a knitted wire mesh material.

13. The turbomachine as in claim 10, wherein the carrier sleeve is configured to allow axial movement of the stator component during operation of the turbomachine.

14. The turbomachine as in claim 10, wherein the portion of the stator component surrounded by the carrier sleeve includes an axially extending shaft fixed to an outer body of the stator component.

15. The turbomachine as in claim 10, wherein the static structure includes multiple struts which extend radially outwardly from the carrier sleeve and connect to an outer shroud.

16. A gas turbine, comprising:

a compressor, a combustion section disposed downstream from the compressor, a turbine disposed downstream from the combustion section and a rotor shaft which extends through the compressor, combustion section and the turbine along an axial centerline of the gas turbine;

a slip ring assembly including a rotating component coupled at one end to a corresponding end of the rotor shaft and a stator component circumferentially surrounding a rotatable center core portion of the rotating component, wherein the center core portion is electronically coupled to one or more sensors disposed within the gas turbine and the stator component is electronically connected to a data acquisition unit, wherein the stator component is axially spaced from the coupled end of the rotating component;

a static structure defining a carrier sleeve, the carrier sleeve circumferentially surrounding a portion of the stator component, wherein the static structure is vibrationally isolated from the gas turbine rotor shaft; and a damping material, the damping material extending radially between an inner surface of the carrier sleeve and an outer surface of the stator component, wherein the damping material dissipates vibrational energy of the slip ring assembly during rotation of the rotor shaft.

17. The gas turbine as in claim 16, wherein the damping material comprises a wire-mesh material.

18. The gas turbine as in claim 17, wherein the wire-mesh material is a knitted wire mesh material.

19. The gas turbine as in claim 16, wherein the portion of the stator component surrounded by the carrier sleeve includes an axially extending shaft fixed to an outer body of the stator component.

20. The gas turbine as in claim 16, wherein the static structure includes multiple struts which extend radially outwardly from the carrier sleeve and connect to an outer shroud.

* * * * *